US010654158B2

(12) United States Patent
Fischer

(10) Patent No.: US 10,654,158 B2
(45) Date of Patent: May 19, 2020

(54) HANDHELD POWER TOOL

(71) Applicant: Hilti Aktiengesellschaft, Schaan (LI)

(72) Inventor: Axel Fischer, Wiedergeltingen (DE)

(73) Assignee: Hilti Aktiengesellschaft, Schaan (LI)

( * ) Notice: Subject to any disclaimer, the term of this patent is extended or adjusted under 35 U.S.C. 154(b) by 518 days.

(21) Appl. No.: 15/309,775

(22) PCT Filed: Apr. 1, 2015

(86) PCT No.: PCT/EP2015/057150
§ 371 (c)(1),
(2) Date: Nov. 8, 2016

(87) PCT Pub. No.: WO2015/169515
PCT Pub. Date: Nov. 12, 2015

(65) Prior Publication Data

US 2017/0144287 A1 May 25, 2017

(30) Foreign Application Priority Data

May 9, 2014 (EP) ..... 14167638

(51) Int. Cl.
*B25D 17/04* (2006.01)
*B25F 5/00* (2006.01)
*B25D 16/00* (2006.01)

(52) U.S. Cl.
CPC ..... *B25D 17/043* (2013.01); *B25D 16/00* (2013.01); *B25F 5/006* (2013.01); *B25D 2222/69* (2013.01)

(58) Field of Classification Search
CPC .. B25D 17/043; B25D 16/00; B25D 2222/69; B25F 5/006
USPC ..... 173/162.2
See application file for complete search history.

(56) References Cited

U.S. PATENT DOCUMENTS 4,401,167 A * 8/1983 Sekizawa ..... B25D 17/043 173/162.1
4,667,749 A * 5/1987 Keller ..... B25D 17/043 173/162.2
4,879,847 A * 11/1989 Butzen ..... B24B 23/00 451/344

(Continued)

FOREIGN PATENT DOCUMENTS

CN 201405334 2/2010
DE 102010040094 3/2012

(Continued)

*Primary Examiner* — Alex M Valvis
*Assistant Examiner* — Katie L Gerth
(74) *Attorney, Agent, or Firm* — Davidson, Davidson & Kappel, LLC

(57) ABSTRACT

The handheld power tool (1) has a tool socket (2) to hold a tool (4) on a working axis (11) as well as a striking mechanism (6) with a striker (14) that is moved periodically back and forth along the working axis (11). The striking mechanism (6) is secured in a tool housing (20). A handle (9) is attached to the tool housing (20) by means of a damper (21). The damper (21) has a surface (25) that is joined to the tool housing (20) as well as a surface (24) that is joined to the handle. A block (27) made of a porous elastomer is arranged so as to be in contact with the tool surface (25) and with the handle surface (26). An air-filled cavity (30) is provided inside the block (27) between the tool surface (25) and the handle surface (24).

9 Claims, 2 Drawing Sheets

(56) References Cited

U.S. PATENT DOCUMENTS 5,038,480 A * 8/1991 Naslund ..... B25D 17/043 173/162.2
5,522,466 A * 6/1996 Harada ..... B25D 17/043 173/162.2
5,692,306 A * 12/1997 Stoll ..... A01D 34/905 173/162.1
5,692,574 A * 12/1997 Terada ..... B25D 17/043 173/162.2
5,699,865 A * 12/1997 Forderer ..... B25F 5/006 173/162.2
6,412,180 B1 * 7/2002 Wolf ..... B27B 17/0033 173/162.2
7,472,760 B2 1/2009 Stirm et al.
7,708,260 B2 * 5/2010 Eicher ..... B25F 5/026 173/162.2
7,806,201 B2 * 10/2010 Aoki ..... B23D 51/16 173/162.2
7,836,971 B2 * 11/2010 Kikuchi ..... B25D 17/043 16/431
9,016,672 B2 4/2015 Englund et al.
2002/0011343 A1 * 1/2002 Iida ..... B27B 17/0033 173/162.2
2007/0034397 A1 * 2/2007 Fischer ..... B25D 17/043 173/162.2
2007/0240890 A1 * 10/2007 Sorric ..... B25D 9/04 173/31
2008/0235913 A1 * 10/2008 Eicher ..... B25F 5/006 16/430
2009/0038818 A1 * 2/2009 Eicher ..... B24B 23/028 173/162.2
2009/0283282 A1 * 11/2009 Zimmermann ..... B25D 17/043 173/162.2
2011/0005790 A1 * 1/2011 Frank ..... B25F 5/006 173/162.2
2011/0155405 A1 * 6/2011 Aoki ..... B25D 17/245 173/162.2
2012/0048580 A1 * 3/2012 Appel ..... B25D 17/043 173/162.2
2012/0111595 A1 * 5/2012 Schadow ..... B25F 5/006 173/162.2

FOREIGN PATENT DOCUMENTS

EP 2050328 10/2007
WO WO2011049496 4/2011

* cited by examiner

HANDHELD POWER TOOL

FIELD OF THE INVENTION

The present invention relates to a handheld power tool, as is known, for example, from German patent application DE 1020 1004 0094 A1.

SUMMARY OF THE INVENTION

The handheld power tool according to the invention has a tool socket to hold a tool on a working axis as well as a striking mechanism with a striker that is moved periodically back and forth along the working axis. The striking mechanism is secured in a tool housing. A handle is attached to the tool housing by means of a damper. The damper has a surface that is joined to the tool housing as well as a surface that is joined to the handle. A block made of a porous elastomer is arranged so as to be in contact with the tool surface and with the handle surface. An air-filled cavity is provided inside the block between the tool surface and the handle surface.

The cavities inside the porous elastomer bring about an increasing stiffness of the damper as the user applies greater contact force. The stiffness can be very easily adapted to the envisaged characteristics. The cavities in the block prove to be sufficiently sturdy under continuous stress, especially vis-à-vis abrasion.

BRIEF DESCRIPTION OF THE DRAWINGS

The description below explains the invention on the basis of embodiments and figures provided by way of an example. The figures show the following.

Unless otherwise indicated, the same or functionally identical elements are designated in the figures by the same reference numerals.

DETAILED DESCRIPTION

Figure 1:
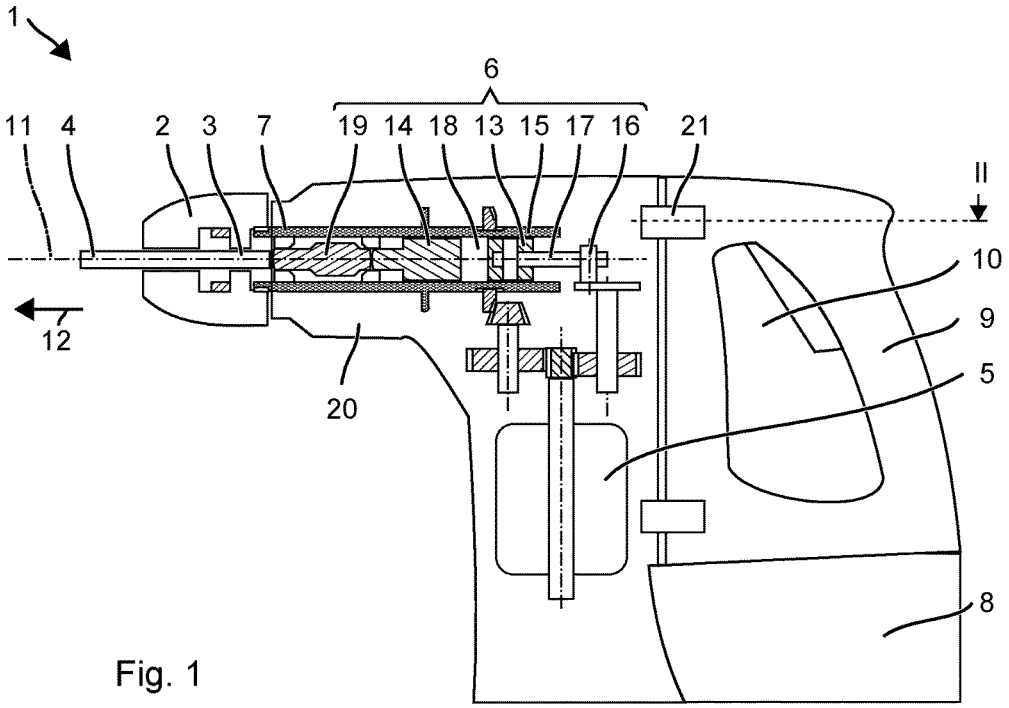
FIG. 1: a hammer drill.

FIG. 1 schematically shows a hammer drill 1 as an example of a hand-held chiseling power tool. The hammer drill 1 has a tool socket 2 into which an shank end 3 of a tool, for example, a drill bit 4, can be inserted. The primary drive of the hammer drill 1 is in the form of a motor 5 that drives a striking mechanism 6 and a driven shaft 7. A battery pack 8 or a mains line supplies the motor 5 with power. The user can guide the hammer drill 1 by means of a handle 9 and can start up the hammer drill 1 by means of a system switch 10. During operation, the hammer drill 1 continuously rotates the drill bit 4 around the working axis 11 and, in this process, it can cause the drill bit 4 to strike into a substrate in the striking direction 12 along the working axis 11.

The striking mechanism 6 is a pneumatic striking mechanism 6. An exciter piston 13 and a striker 14 are installed movably along the working axis 11 in a guide tube 15 in the striking mechanism 6. The exciter piston 13 is coupled to the motor 5 via an eccentric 16 and it is forced to execute a periodical, linear movement. A connecting link 17 connects the eccentric 16 to the exciter piston 13. A pneumatic spring that is formed by a pneumatic chamber 18 between the exciter piston 13 and the striker 14 couples a movement of the striker 14 to the movement of the exciter piston 13. The striker 14 can strike a rear end of the drill bit 4 directly, or it can transfer some of its pulse to the drill bit 4 indirectly via an essentially stationary intermediate striker 19. The striking mechanism 6 and preferably the additional drive components are arranged inside a tool housing 20.

A recoil of the pneumatic striking mechanism 6 is transferred via the tool housing 20 onto the handle 9. The handle 9 is suspended on the tool housing 20 by means of a damper 21 in order to reduce the peak load of the recoil. The damper 21 is depicted in a sectional view in FIG. 2. The damper 21 has a stamp 22 that is rigidly attached to the handle 9. The stamp 22 is situated in a cage 23 that is rigidly attached to the tool housing 20. The stamp 22 can be moved in the cage 23 along the working axis 11. The stamp 22 has a stamp surface 24 which faces in the striking direction 12 and which is located opposite from a stop surface 25 of the cage 23 facing counter to the striking direction 12. The two surfaces 24, 25 are preferably flat or, if they are bent, they have the same curvature. The stamp surface 24 is essentially uniform along its entire surface area all the way to the stop surface 25 at a distance 26.

Figure 2:
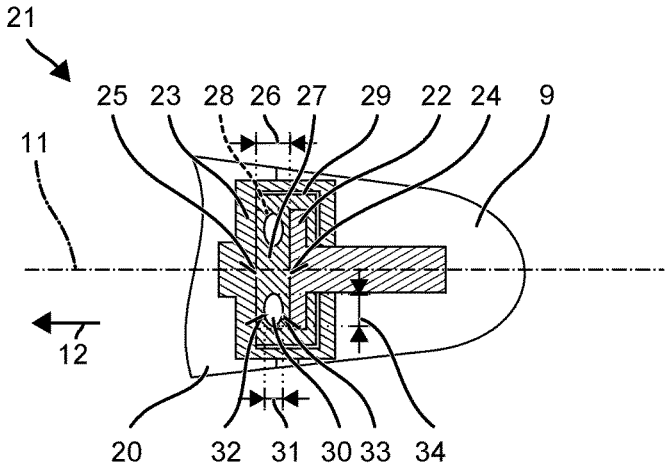
FIG. 2: a sectional view through a handle decoupling element of the hammer drill in plane II.

The damper 21 has a porous elastomer element 27 arranged between the stamp 22 and the cage 23. In the striking direction 12, the porous elastomer element 27 transmits a force from the handle 9 to the tool housing 20. The porous elastomer element 27 has a buffer section 28 that is in contact with the stamp surface 24 and the opposite stop surface 25. The dimensions of the buffer section 28 perpendicular to the working axis 11 are the same as the corresponding dimensions of the stamp surface 24 that is attached here, for instance, to the handle 9. The outer surface of the porous elastomer element 27 that faces in the striking direction 12 preferably rests flush and completely against the stop surface 25, at least in the buffer section 28. By the same token, the outer surface of the buffer section 28 that faces counter to the striking direction 12 preferably rests flush and completely against the stamp surface 24. The porous elastomer element 27, especially the buffer section 28, is compressed when the user exerts pressure onto the handle 9 in the striking direction 12. In addition to the contact force, the vibrations of the hammer drill 1 also act dynamically on the porous elastomer element 27. Since the construction of the buffer section 28 is such that it is continuously in contact with the stamp surface 24 and with the stop surface 25, it is effectively prevented that the buffer section 28 moves parallel to the stamp surface 24 and to the stop surface 25 in case of dynamic load changes. Especially in view of the dusty working environment of the hammer drill 1, the porous elastomer element 27 suffers a great deal of wear and tear, particularly in the case of an elastomer element 27 that is rubber-free and open-pored, as is preferred for the damping. The outer surfaces of the porous elastomer element 27 that perpendicularly face the working axis 11 are preferably surrounded by an air gap 29. This air gap 29 is dimensioned sufficiently for the porous elastomer element 27 not to touch the sides of the cage 23 or of another housing due to compression or due to the contact force being exerted by the user. The porous elastomer element 27 preferably has a prismatic structure. Along one axis, here, for instance, along the handle axis, the porous elastomer element 27 has a constant cross section (FIG. 2). Therefore, the porous elastomer element 27 can be cut out of a cube using a water-jet saw.

The porous elastomer element 27 shown has, for instance, two air-filled cavities 30. The cavities 30 are arranged inside the buffer section 28, that is to say, between the stamp surface 24 and the stop surface 25. In this context, the cavities 30 are located inside the buffer section 28 in that they are not open towards the stamp surface 24 or the stop surface 25. The cavity 30 is closed along the working axis 11. The cavity 30 can be open in a direction perpendicular to the working axis 11. The cavities 30 shown by way of an example have a cylindrical shape with an elliptical cross section that extends through the entire porous elastomer element 27. Here, the axes of the cavities 30 are shown by way of an example as being parallel to the handle axis. The largest dimension 31 of the cavity 30 along the working axis 11, here the smaller half-axis of the ellipse, amounts to between 20% and 50% of the distance 26 between the stamp surface 24 and the stop surface 25, in other words, the axial outer dimension of the buffer section 28. The axial dimensions of the porous elastomer element 27 should be determined without external force being applied onto the damper 21, especially without any contact force being exerted onto the handle 9 by the user. When the handle 9 is pushed in the striking direction 12, the cavities 30 are compressed to an increasing degree, until the opposite inner surfaces 32, 33 of the cavity 30 come to rest against each other completely. As a result, the stiffness of buffer section 28 increases due to the growing contact force until the cavity 30 is closed. The damper 21, which is soft at a low holding force, only transmits very few vibrations when the user holds the handle 9 loosely. As the contact force increases, more vibrations are transmitted in principle, but the arm of the user also accounts for a natural damping. The latter effect undergoes saturation, which is why beyond a medium level of holding force, any further increase in the stiffness is ergonomically disadvantageous.

The cavity 30 preferably has a cross section that remains constant along one axis. The axis is perpendicular to or slanted with respect to the working axis 11. The cross section of the cavity 30 is closed annularly. The cross section has a dimension 31 along the working axis 11 and a dimension 34 perpendicular to the working axis 11. The dimension 34 perpendicular to the working axis 11 is preferably at least twice as large as the dimension 31 along the working axis 11. The opposite inner surfaces 32, 33 can touch each other, especially the points that were originally furthest away along the working axis, without this causing crack formation in the porous elastomer element 27 during the dynamic loads.

Figure 3:
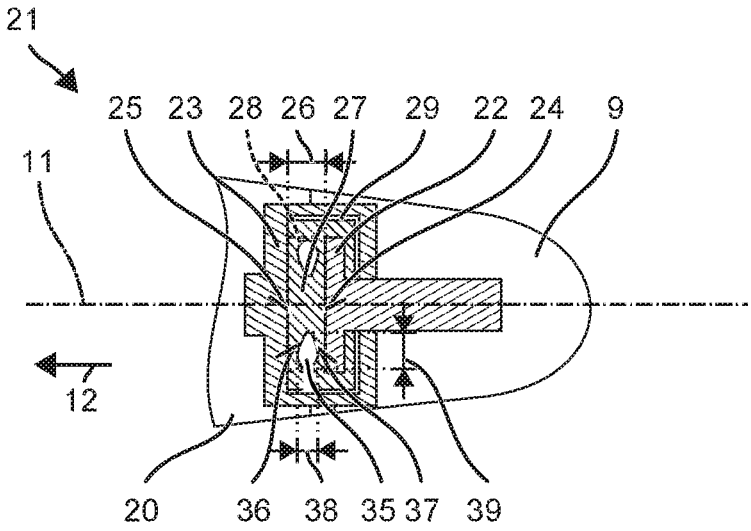
FIG. 3: a sectional view through a handle decoupling element of a hammer drill in plane II.

FIG. 3 illustrates the elastomer element 27 with cavities 35 that are configured differently. The cavity 35 has a drop-shaped cross section. An inner surface 36 that faces the cage 23 as well as an opposite inner surface 37 that faces the stamp 22 are essentially flat and converge to form a tip. The two inner surfaces 36, 37 are appropriately inclined relative to each other by an angle between 30° and 90°. Opposite from the tip, the two flat inner surfaces 36, 37 are connected by a semi-cylindrical inner surface. The axis of the drop shape, that is to say, leading from the tip to the semi-cylinder, runs perpendicular to the working axis 11. The width 38 of the drop, that is to say, its dimension 34 along the working axis 11, is preferably between 20% and 50% of the distance 26 between the stamp surface 24 and the stop surface 25. The length 39 of the drop, that is to say, along its axis through the tip, is greater than the width 38, preferably at least twice as large. The bottom cavity 35 is depicted schematically as being open in the direction perpendicular to the working axis.

What is claimed is:

1. A handheld power tool comprising:

a tool socket to hold a tool on a working axis;

a striking mechanism with a striker moved periodically back and forth along the working axis;

a tool housing, the striking mechanism being secured in the tool housing;

a handle attached to the tool housing via a damper, the damper having a tool surface joined to the tool housing, a handle surface joined to the handle, and a block made of a porous elastomer arranged to be in contact with the tool surface and with the handle surface, an air-filled cavity being provided inside the block between the tool surface and the handle surface; a dimension of the cavity along the working axis amounting to between 20% and 50% of the distance between the tool surface and the handle surface along the working axis.

2. The handheld power tool as recited in claim 1, wherein a dimension of the cavity along the working axis is less than a further dimension of the cavity perpendicular to the working axis.

3. The handheld power tool as recited in claim 1, wherein the cavity is closed along the working axis.

4. The handheld power tool as recited in claim 1, wherein the dimension of the cavity along the working axis has a varying cross section curved at one end and pointed in another end along an axis perpendicular to the working axis.

5. The handheld power tool as recited in claim 4, wherein the cavity is open along an axis perpendicular to the working axis.

6. The handheld power tool as recited in claim 1 wherein the tool surface is joined to the tool housing via a cage rigidly attached to the tool housing.

7. The handheld power tool as recited in claim 1 wherein the handle surface is joined to the handle via a stamp rigidly attached to the handle.

8. The handheld power tool as recited in claim 6 wherein the handle surface is joined to the handle via a stamp rigidly attached to the handle.

9. The handheld power tool as recited in claim 8 wherein the stamp is situated in the cage.

* * * * *